US012774543B2

(12) United States Patent
Yu et al.

(10) Patent No.: US 12,774,543 B2
(45) Date of Patent: Oct. 27, 2026

(54) TRANSFER APPARATUS

(71) Applicant: Zhejiang Yifan Automation Equipment Co., Ltd., Huzhou City (CN)

(72) Inventors: Baohua Yu, Huzhou City (CN); Ruibing Li, Huzhou City (CN); Xiaojun Chen, Huzhou City (CN); Lianqing Gu, Huzhou City (CN); Qingxiang Zhang, Huzhou City (CN)

( * ) Notice: Subject to any disclaimer, the term of this patent is extended or adjusted under 35 U.S.C. 154(b) by 0 days.

(21) Appl. No.: 19/542,614

(22) Filed: Feb. 17, 2026

(65) Prior Publication Data

US 2026/0242988 A1 Aug. 20, 2026

(30) Foreign Application Priority Data

Feb. 18, 2025 (CN) ..... 202510177671.3

(51) Int. Cl.
*D04B 9/56* (2006.01)
*D04B 9/46* (2006.01)
*D04B 15/88* (2006.01)

(52) U.S. Cl.
CPC ..... *D04B 9/56* (2013.01); *D04B 9/46* (2013.01); *D04B 15/88* (2013.01)

(58) Field of Classification Search
CPC ..... D04B 15/32; D04B 15/34; D04B 15/88; D04B 9/40; D04B 9/46; D04B 9/56
USPC ..... 66/147, 148, 149 R, 58, 59
See application file for complete search history.

(56) References Cited

U.S. PATENT DOCUMENTS 4,010,626 A * 3/1977 Feher ..... D04B 1/104 66/93
6,826,930 B2 * 12/2004 Frullini ..... D04B 9/40 66/148
8,028,546 B2 * 10/2011 Lonati ..... D04B 9/40 66/148
8,443,633 B1 * 5/2013 Inli ..... D04B 15/02 66/148
8,893,529 B1 * 11/2014 Inli ..... D04B 9/40 66/148
9,273,422 B2 * 3/2016 Inli ..... D04B 15/02
9,562,307 B2 * 2/2017 Conti ..... D04B 15/92
9,970,136 B2 * 5/2018 Inli ..... D04B 9/56
2016/0258088 A1 * 9/2016 Inli ..... D04B 1/26
2020/0056311 A1 * 2/2020 Inli ..... D04B 15/40

FOREIGN PATENT DOCUMENTS

EP 2377979 A1 * 10/2011 ..... D04B 9/40

* cited by examiner

*Primary Examiner* — Danny Worrell

(57) ABSTRACT

A transfer apparatus for knitting machinery includes a transfer disk with a plurality of transfer needles distributed circumferentially. Each transfer needle is suspended from the bottom of the transfer disk via a sliding block and rail structure and is configured to move horizontally in a radial direction. A force-receiving portion on each needle extends through a groove to the top of the transfer disk. At least three radial push plates, distributed circumferentially at the top of the transfer disk and connected to a radial driving mechanism, act on the force-receiving portions to push the needles radially outward. Each transfer needle further includes a return force-applying portion. The sliding block and rail structure constrains the needles to horizontal radial movement relative to the transfer disk.

8 Claims, 11 Drawing Sheets

TRANSFER APPARATUS

TECHNICAL FIELD

The present disclosure belongs to the technical field of knitting machinery, and relates to a transfer apparatus.

BACKGROUND

During the production of socks, a semi-finished sock is generally produced in a needle cylinder of a hosiery machine. At this time, a sock toe is not sewn, then the semi-finished sock is taken out of the needle cylinder by a transfer apparatus and transferred to a toe sewing disk, and the sock toe of the sock is sewn by a toe sewing machine. The transfer apparatus includes a transfer needle arranged on a transfer disk body. The transfer needle is driven by a driving mechanism to move in a radial direction of the transfer disk body and cooperates with a vertical knitting needle of the hosiery machine to perform a hosiery thread transfer operation.

An existing transfer needle driving mechanism has poor driving accuracy and driving stability, which easily leads to missed stitches, snagged loops and dropped stitches of the transfer needle. Furthermore, due to poor positioning accuracy and accuracy control or external influences such as a driving mode, the transfer needle is highly prone to position deviation during the radial movement, thereby seriously affecting the product quality, and increasing the defective rate and the loss of equipment and materials. Frequent shutdown is required for adjustment, thereby reducing the production efficiency.

SUMMARY

An objective of the present disclosure is to provide a transfer apparatus for the above problems.

To achieve the above objective, the present disclosure adopts the following technical solutions:

a transfer apparatus includes a transfer disk, the transfer disk is provided with a plurality of transfer needles distributed in a circumferential direction thereof and capable of moving horizontally in a radial direction thereof, a return force-applying portion is arranged on each of the transfer needles, each of the transfer needles is suspended at the bottom of the transfer disk through a sliding block and sliding rail structure, each of the transfer needles is provided with a force-receiving portion, the force-receiving portion penetrates through a force-receiving portion moving groove of the transfer disk to be exposed out of the top of the transfer disk, at least three radial push plates distributed in the circumferential direction are arranged at the top of the transfer disk, when moving outward, each of the radial push plates can act on the force-receiving portion to push each of the transfer needles to move outward radially, and each of the radial push plates is connected to a radial driving mechanism.

The radial driving mechanism can synchronously drive the radial push plates to move outward in the radial direction of the transfer disk. The radial push plates can act on the force-receiving portion of each of the transfer needles evenly, so that each of the transfer needles is stressed uniformly, and each of the transfer needles can move outward radially and stably at a constant speed. The driving accuracy and the driving stability are high. The sliding block and sliding rail structure can limit the transfer needles to only moving horizontally in the radial direction of the transfer disk, thereby ensuring that the transfer needles have no deviation on other positions during the radial movement, achieving accuracy control, facilitating the accurate control of the positions of the transfer needles, ensuring accurate operation, reducing the operation complexity and the risk of errors, and ensuring the quality and efficiency of the hosiery thread transfer operation.

In the above transfer apparatus, the radial driving mechanism includes an eccentric wheel, a radial movement guide assembly is arranged between each of the radial push plates and the transfer disk, end parts of two adjacent radial push plates overlap each other, the end parts of the radial push plates are provided with strip-shaped holes at the overlapped positions, an eccentric body of the eccentric wheel is arranged in the strip-shaped holes, during rotation, the eccentric wheel can drive the radial push plates to move radially, and the eccentric wheel is connected to an eccentric wheel driving assembly.

The eccentric wheel driving assembly can drive the eccentric wheel to rotate. When the eccentric wheel rotates, the eccentric body of the eccentric wheel acts on the strip-shaped holes of the radial push plates to drive the radial push plates to move in the radial direction of the transfer disk. The radial movement guide assembly plays a role of radial movement guidance during the movement of the radial push plates in the radial direction of the transfer disk, so that no deviation of the movement positions of the radial push plates is ensured, and the radial push plates can act on the force-receiving portion of each of the transfer needles evenly to achieve accuracy control, facilitate the accurate control of the positions of the transfer needles and ensure accurate operation.

In the above transfer apparatus, the eccentric wheel driving assembly includes outer tooth bodies arranged on a main wheel of the eccentric wheel, a plurality of outer tooth bodies are connected to a driving tooth ring, and the driving tooth ring is connected to a tooth ring driving unit.

The tooth ring driving unit can drive the driving tooth ring to rotate, and the driving tooth ring is engaged with the outer tooth bodies for transmission. During rotation, the driving tooth ring can drive the main wheel of the eccentric wheel to rotate so as to drive the radial push plates to move radially.

In the above transfer apparatus, the bottom and the top of the main wheel are in contact connection with the radial push plates and an annular cover plate, respectively, and a central shaft of the main wheel penetrates through the annular cover plate and can rotate between the radial push plates and the annular cover plate;

the bottom of the driving tooth ring is in contact connection with an upper surface of each of the radial push plates and an inner step on an inner side of a positioning disk of the transfer disk, and an upper surface of the driving tooth ring is in contact connection with the annular cover plate; and the annular cover plate is fixed on the transfer disk.

The central shaft of the main wheel penetrates through the annular cover plate and can rotate between the radial push plates and the annular cover plate, the annular cover plate and the central shaft play a role of positioning the main wheel, and the inner step on the inner side of the positioning disk plays a role of rotational positioning the driving tooth ring to ensure the rotating accuracy of the driving tooth ring.

In the above transfer apparatus, the radial movement guide assembly includes a radial strip-shaped groove formed in each of the radial push plates, and a positioning pin fixed on the transfer disk penetrates into the radial strip-shaped groove.

The positioning pin on the transfer disk penetrates through the radial strip-shaped groove. The positioning pin cooperates with the radial strip-shaped groove to play a role of radial movement guidance in the movement process of the radial push plates in the radial direction of the transfer disk, thereby ensuring no deviation of the movement positions of the radial push plates to ensure the movement accuracy of the radial push plates.

In the above transfer apparatus, an arc-shaped inclined plate inclining outward gradually from top to bottom is arranged outside each of the radial push plates, an annular groove is formed between a plurality of force-receiving portion moving grooves and the top of the transfer disk, an upper end of the force-receiving portion and the arc-shaped inclined plate are arranged in the annular groove, and an outer end of the arc-shaped inclined plate abuts against an inner side of the force-receiving portion.

When the radial push plates move outward in the radial direction of the transfer disk, the arc-shaped inclined plate outside each of the radial push plates acts on the force-receiving portion of each of the transfer needles to push the transfer needles to move outward in the radial direction of the transfer disk.

In the above transfer apparatus, the tooth ring driving unit includes a driving connection lug arranged on an outer wall of the driving tooth ring, and the driving connection lug can be connected to a tooth ring rotating driver.

The tooth ring rotating driver operates to drive the driving tooth ring by the driving connection lug to rotate.

In the above transfer apparatus, the sliding block and sliding rail structure includes a sliding groove formed at the bottom of the transfer disk and extending in a radial direction thereof, a sliding block is arranged in the sliding groove, the bottom of the sliding block is fixed to the top of each of the transfer needles, a transfer needle anti-shaking groove enabling the transfer needles to move in the radial direction of the transfer disk is formed between the sliding groove and the bottom of the transfer disk, the force-receiving portion is arranged on a rear end of each of the transfer needles, and a front end of each of the transfer needles is a hooked tip.

In the movement process of the transfer needles in the radial direction of the transfer disk, the sliding groove at the bottom of the transfer disk cooperates with the sliding block at the top of each of the transfer needles to limit the transfer needles to only moving horizontally in the radial direction of the transfer disk, thereby ensuring that the transfer needles have no deviation on other positions during the radial movement, achieving accuracy control, and facilitating the accurate control of the positions of the transfer needles. The transfer needle anti-shaking groove is used to accommodate the transfer needles and allow the transfer needles to move in the radial direction of the transfer disk, so that shaking of the transfer needles can be effectively avoided in the movement process, thereby achieving accuracy control and ensuring no deviation of the positions of the transfer needles.

In the above transfer apparatus, an outer end of the sliding block is sleeved on the force-receiving portion and is connected to each of the transfer needles through a mortise-and-tenon structure, an inner end of the sliding block is provided with a hole groove, a positioning column at the top of each of the transfer needles penetrates into the hole groove, a gap is reserved between the hole groove and the positioning column, so that the sliding block can move axially after the hole groove is sleeved into the positioning column to lock the mortise-and-tenon structure, and the sliding block, the positioning column and the transfer needles are fixed in the gap through welding, bonding or snap-fitting.

The sliding block is fixedly connected to each of the transfer needles through the mortise-and-tenon structure, the fixation is stable, the positioning column at the top of each of the transfer needles penetrates into the hole groove at the front end of the sliding block and cooperates with the hole groove to play a positioning role, the gap reserved between the hole groove and the positioning column facilitates the locking of the mortise-and-tenon structure, and the sliding block, the positioning column and each of the transfer needles are fixed in the gap through welding, bonding or snap-fitting to ensure stable connection.

In the above transfer apparatus, the mortise-and-tenon structure includes a mortise arranged at one end of the sliding block, the force-receiving portion is located on a rear end part of each of the transfer needles, the mortise is sleeved on the force-receiving portion, and after the mortise is sleeved on the force-receiving portion, the sliding block is moved axially, so that one end of the sliding block is clamped in a groove of the force-receiving portion, and the other end of the sliding block is fixedly connected to each of the transfer needles;

a reinforcing rib is arranged on one side of the force-receiving portion away from the groove, the reinforcing rib, each of the transfer needles and the force-receiving portion are connected into a whole, a gap is formed between the mortise and the reinforcing rib, and the reinforcing rib, the sliding block and each of the transfer needles are fixed in the gap through welding, bonding or snap-fitting.

The reinforcing rib on the force-receiving portion cooperates with the mortise of the sliding block to enhance the connection strength between the sliding block and each of the transfer needles, thereby further ensuring the stable connection between the sliding block and each of the transfer needles. The gap between the mortise and the reinforcing rib facilitates the locking of the mortise-and-tenon structure, and the reinforcing rib, the sliding block and each of the transfer needles are fixed in the gap through welding, bonding or snap-fitting, so that the connection stability between the sliding block and each of the transfer needles can be ensured.

In the above transfer apparatus, each of the transfer needles is sheet-like, a maximum width of the sliding block is greater than a width of each of the transfer needles, and one side of the sliding block is flush with a side surface of each of the transfer needles and the other side of the sliding block protrudes from a side wall of each of the transfer needles;

or two sides of the sliding block protrude from side walls of two sides of each of the transfer needles, respectively.

The maximum width of the sliding block is greater than the width of each of the transfer needles, thereby ensuring the stable connection between the sliding block and each of the transfer needles.

In the above transfer apparatus, the return force-applying portion is arranged at a rear end of each of the transfer needles; and an opening of the hooked tip and the force-receiving portion are located at the top of each of the transfer needles, and a clearance groove is formed at an outer end of the hooked tip.

The clearance groove at the outer end of the hooked tip enables a loop on a sock knitting needle to enter a traction surface of the hooked tip easily when the hooked tip is close to the sock knitting needle.

Compared with the prior art, the present disclosure has the following advantages: 1. the radial push plates can evenly act on the force-receiving portion of each of the transfer needles, each of the transfer needles is stressed evenly and can move outward radially and stably at a constant speed, and the driving accuracy and the driving stability are high. 2. The transfer needles only can move horizontally in the radial direction of the transfer disk, so that it can be ensured that the transfer needles have no deviation on other positions during the radial movement, accuracy control is achieved, accurate control of the positions of the transfer needles is facilitated, and the quality and efficiency of the hosiery thread transfer operation can be ensured. 3. The movement positions of the radial push plates will not deviate in the movement process, and the driving accuracy is high.

DETAILED DESCRIPTION OF THE EMBODIMENTS

Figure 1:
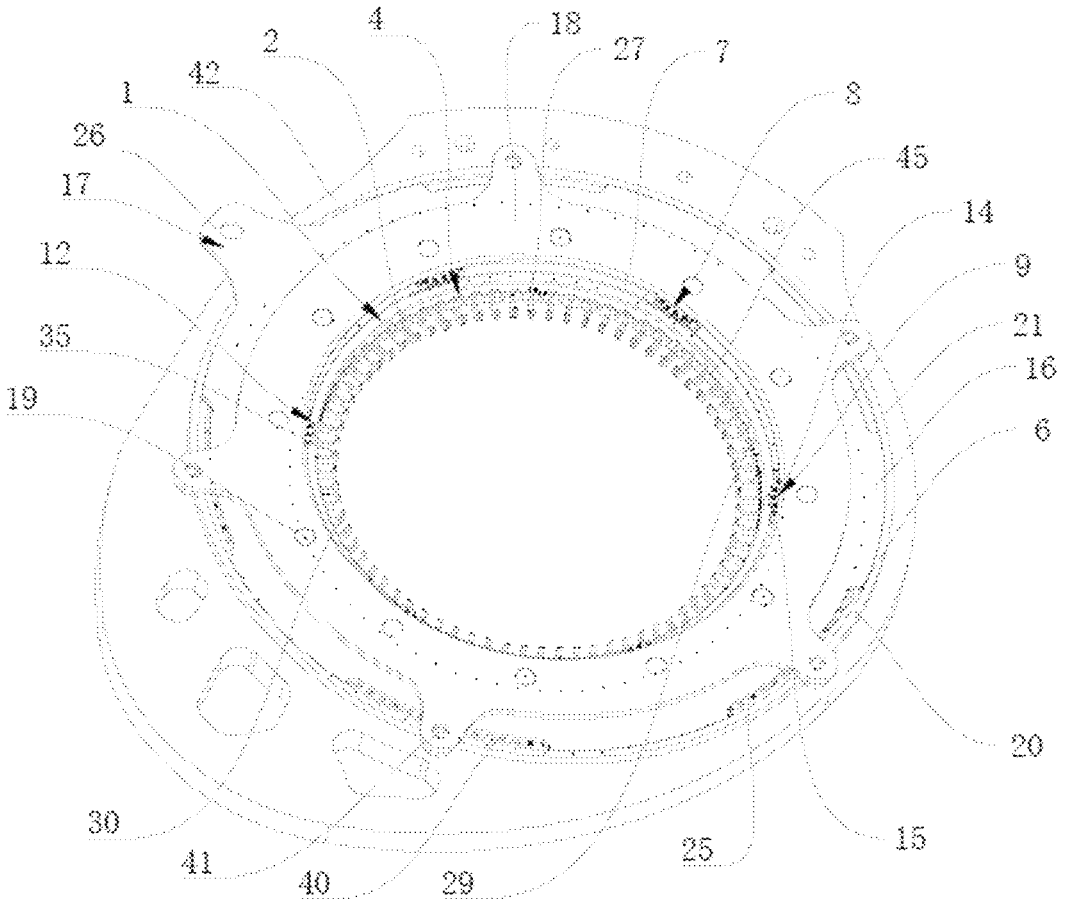
FIG. 1 is a schematic diagram of an overall structure according to the present disclosure.

As shown in FIG. 1 to FIG. 4, a transfer apparatus includes a transfer disk 1, the transfer disk 1 is provided with a plurality of transfer needles 2 distributed in a circumferential direction thereof and capable of moving horizontally in a radial direction thereof, a return force-applying portion 3 is arranged on each of the transfer needles 2, each of the transfer needles 2 is suspended at the bottom of the transfer disk 1 through a sliding block and sliding rail structure 4, each of the transfer needles 2 is provided with a force-receiving portion 5, the force-receiving portion 5 penetrates through a force-receiving portion moving groove 6 of the transfer disk 1 to be exposed out of the top of the transfer disk 1, at least three radial push plates 7 distributed in the circumferential direction are arranged at the top of the transfer disk 1, when moving outward, each of the radial push plates 7 can act on the force-receiving portion 5 to push each of the transfer needles 2 to move outward radially, and each of the radial push plates 7 is connected to a radial driving mechanism 8.

In the present disclosure, the radial driving mechanism 8 can synchronously drive the radial push plates 7 to move outward in the radial direction of the transfer disk 1; when moving outward in the radial direction of the transfer disk 1, the radial push plates 7 can act on the force-receiving portion 5 of each of the transfer needles 2 to push the transfer needles 2 to move outward in the radial direction of the transfer disk 1; the return force-applying portion 3 on each of the transfer needles 2 can reset each of the transfer needles 2, so that each of the transfer needles 2 moves inward in the radial direction of the transfer disk 1 to reset; and in the movement process in the radial direction of the transfer disk 1, the transfer needles 2 cooperate with a vertical knitting needle of a hosiery machine to perform a hosiery thread transfer operation.

The radial driving mechanism 8 can synchronously drive the radial push plates 7 to move outward in the radial direction of the transfer disk 1. The radial push plates 7 can act on the force-receiving portion 5 of each of the transfer needles 2 evenly, so that each of the transfer needles 2 is stressed uniformly, and each of the transfer needles 2 can move outward radially and stably at a constant speed. The driving accuracy and the driving stability are high. Each of the transfer needles 2 is suspended at the bottom of the transfer disk 1 through a sliding block and sliding rail structure 4. The sliding block and sliding rail structure 4 can limit the transfer needles 2 to only moving horizontally in the radial direction of the transfer disk 1, thereby ensuring that the transfer needles 2 have no deviation on other positions during the radial movement, achieving accuracy control, facilitating the accurate control of the positions of the transfer needles 2, ensuring accurate operation, reducing the operation complexity and the risk of errors, and ensuring the quality and efficiency of the hosiery thread transfer operation.

Specifically, referring to FIG. 1 to FIG. 6, the radial driving mechanism 8 includes an eccentric wheel 9, a radial movement guide assembly 10 is arranged between each of the radial push plates 7 and the transfer disk 1, end parts of two adjacent radial push plates 7 overlap each other, the end parts of the radial push plates 7 are provided with strip-shaped holes 11 at the overlapped positions, an eccentric body 13 of the eccentric wheel 9 is arranged in the strip-shaped holes 11, during rotation, the eccentric wheel 9 can drive the radial push plates 7 to move radially, and the eccentric wheel 9 is connected to an eccentric wheel driving assembly 12.

The eccentric wheel driving assembly 12 can drive the eccentric wheel 9 to rotate. When the eccentric wheel 9 rotates, the eccentric body 13 of the eccentric wheel 9 acts on the strip-shaped holes 11 of the radial push plates 7 to drive the radial push plates 7 to move in the radial direction of the transfer disk 1. The radial movement guide assembly 10 between each of the radial push plates 7 and the transfer disk 1 plays a role of radial movement guidance during the movement of the radial push plates 7 in the radial direction of the transfer disk 1, so that no deviation of the movement positions of the radial push plates 7 is ensured, and the radial push plates 7 can act on the force-receiving portion 5 of each of the transfer needles 2 evenly to achieve accuracy control, facilitate the accurate control of the positions of the transfer needles 2 and ensure accurate operation.

Figure 2:
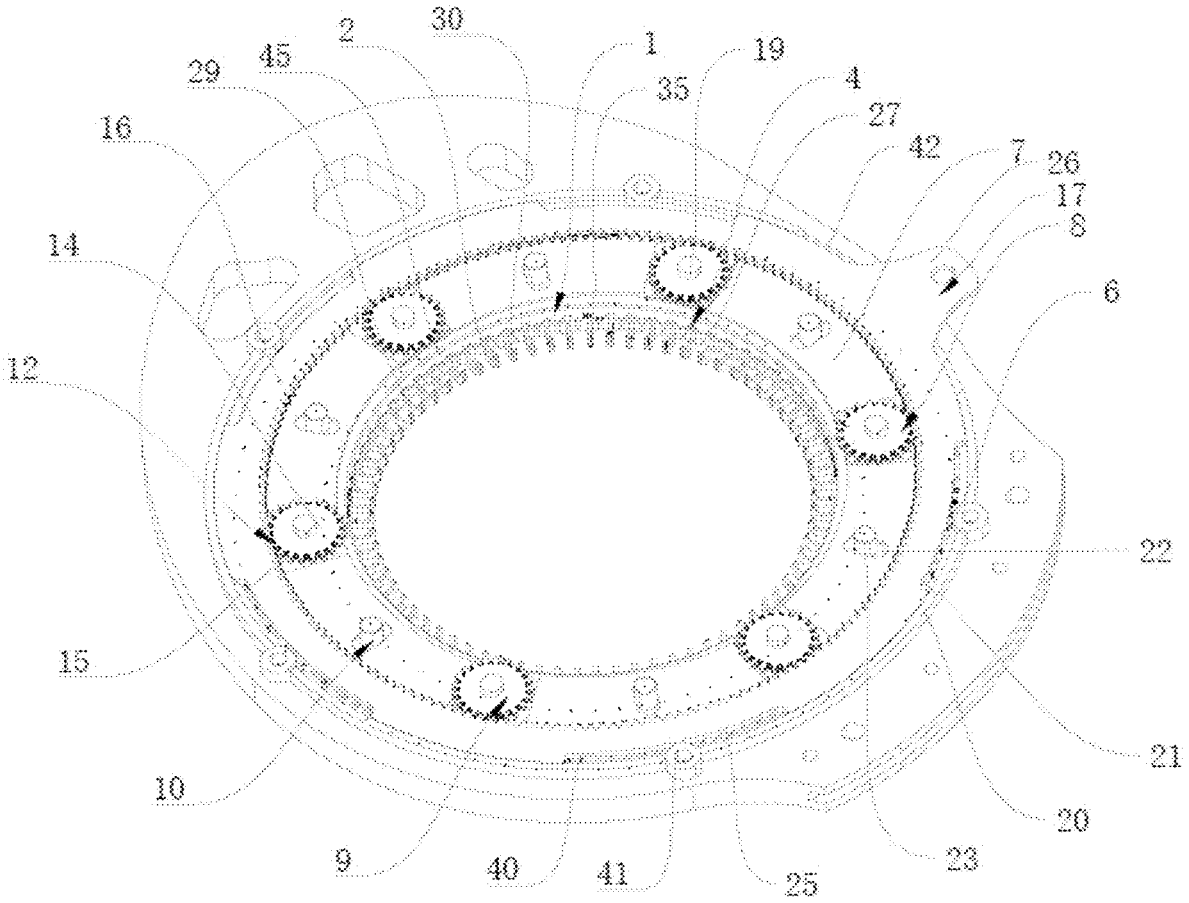
FIG. 2 is a structural schematic diagram of a radial driving mechanism.
Figure 3:
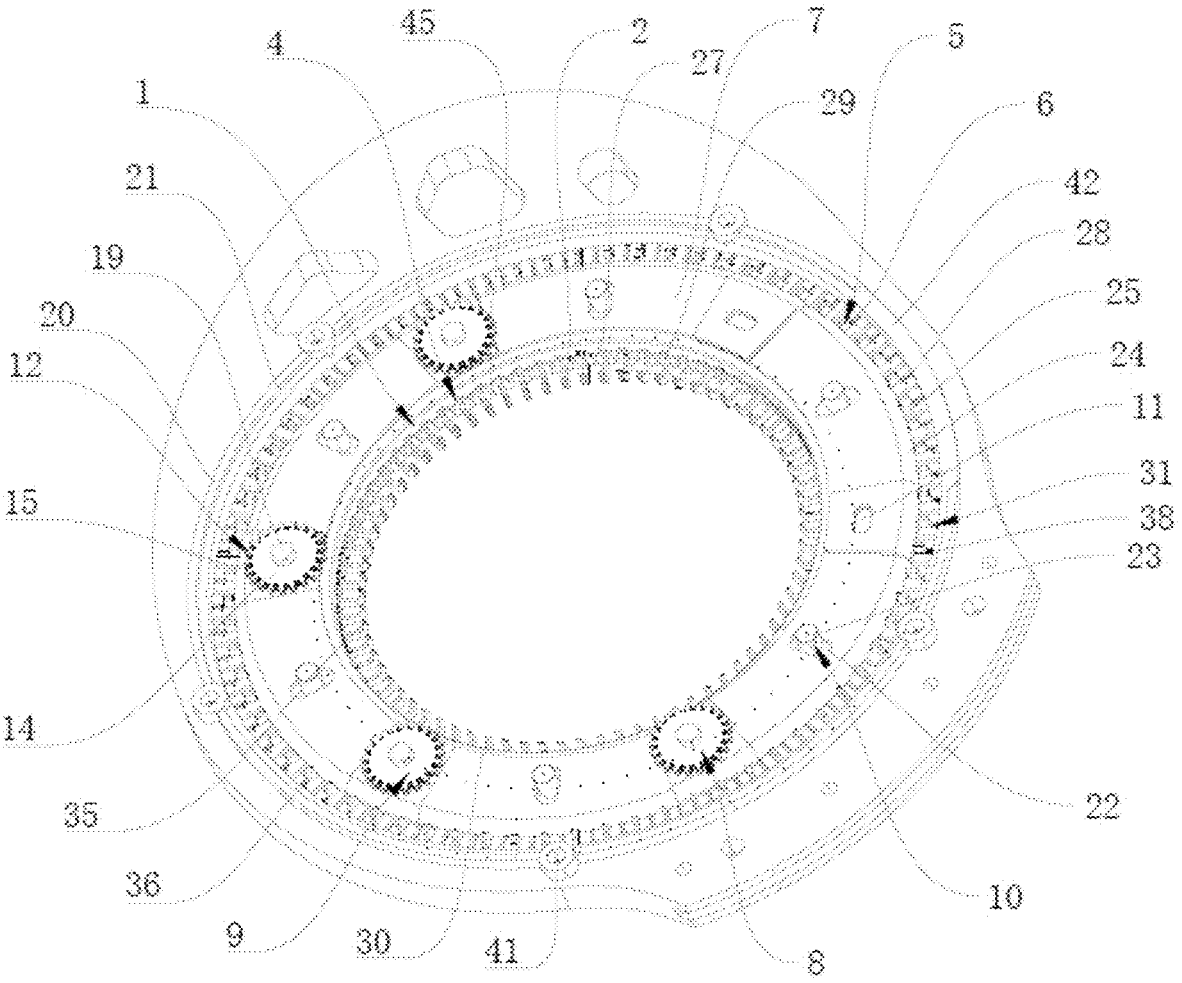
FIG. 3 is a structural schematic diagram of an eccentric wheel driving assembly.
Figure 4:
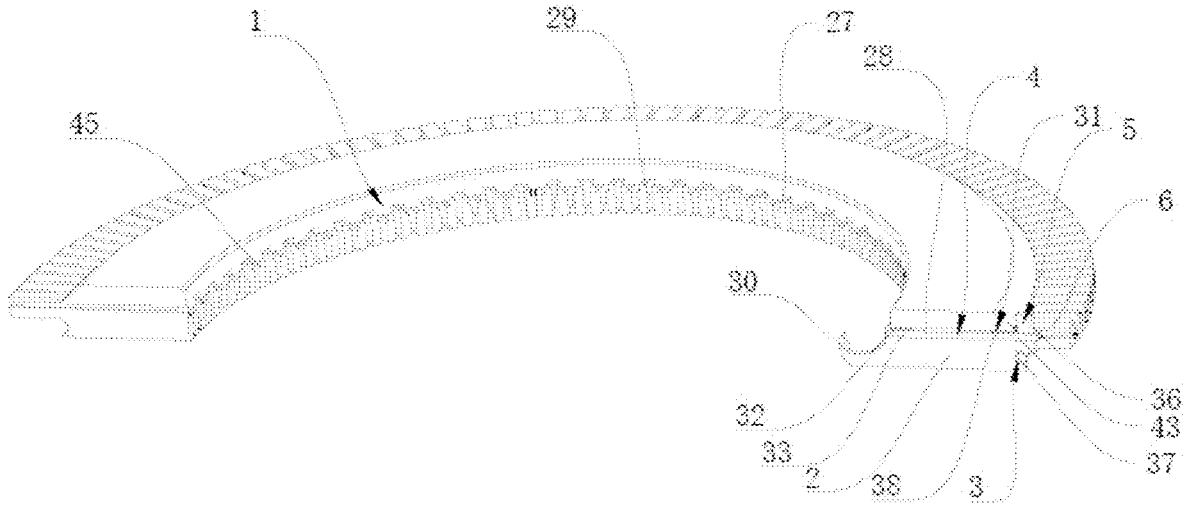
FIG. 4 is an assembling schematic diagram of a transfer needle.

Specifically, referring to FIG. 1 to FIG. 3, the eccentric wheel driving assembly 12 includes outer tooth bodies 15 arranged on a main wheel 14 of the eccentric wheel 9, a plurality of outer tooth bodies 15 are connected to a driving tooth ring 16, the driving tooth ring 16 is connected to a tooth ring driving unit 17, the tooth ring driving unit 17 includes a driving connection lug 26 arranged on an outer wall of the driving tooth ring 16, and the driving connection lug 26 can be connected to a tooth ring rotating driver.

The tooth ring rotating driver operates to drive the driving tooth ring 16 by the driving connection lug 26 to rotate. The driving tooth ring 16 is engaged with the outer tooth bodies 15 for transmission. During rotation, the driving tooth ring 16 can drive the main wheel 14 of the eccentric wheel 9 to rotate so as to drive the radial push plates 7 to move radially.

Specifically, referring to FIG. 1 to FIG. 3, the bottom and the top of the main wheel 14 are in contact connection with the radial push plates 7 and an annular cover plate 18, respectively, and a central shaft 19 of the main wheel 14 penetrates through the annular cover plate 18 and can rotate between the radial push plates 7 and the annular cover plate 18;

the bottom of the driving tooth ring 16 is in contact connection with an upper surface of each of the radial push plates 7 and an inner step 21 on an inner side of a positioning disk 20 of the transfer disk 1, and an upper surface of the driving tooth ring 16 is in contact connection with the annular cover plate 18; and the annular cover plate 18 is fixed on the transfer disk 1.

The central shaft 19 of the main wheel 14 penetrates through the annular cover plate 18 and can rotate between each of the radial push plates 7 and the annular cover plate 18, the annular cover plate 18 and the central shaft 19 play a role of positioning the main wheel 14, and the inner step 21 on the inner side of the positioning disk 20 plays a role of rotational positioning the driving tooth ring 16 to ensure the rotating accuracy of the driving tooth ring 16.

Figure 5:
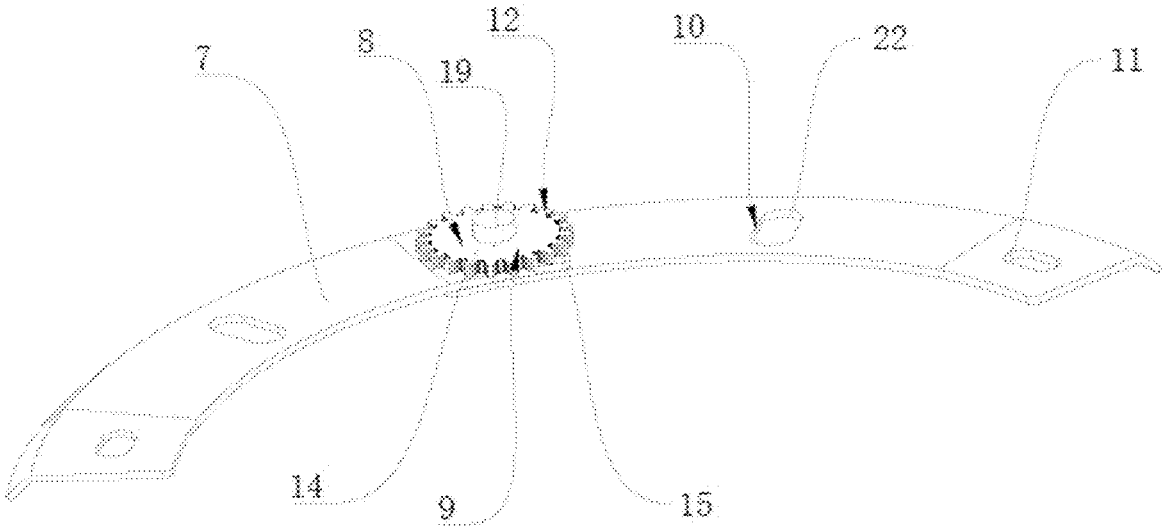
FIG. 5 is a structural schematic diagram of a radial push plate.
Figure 6:
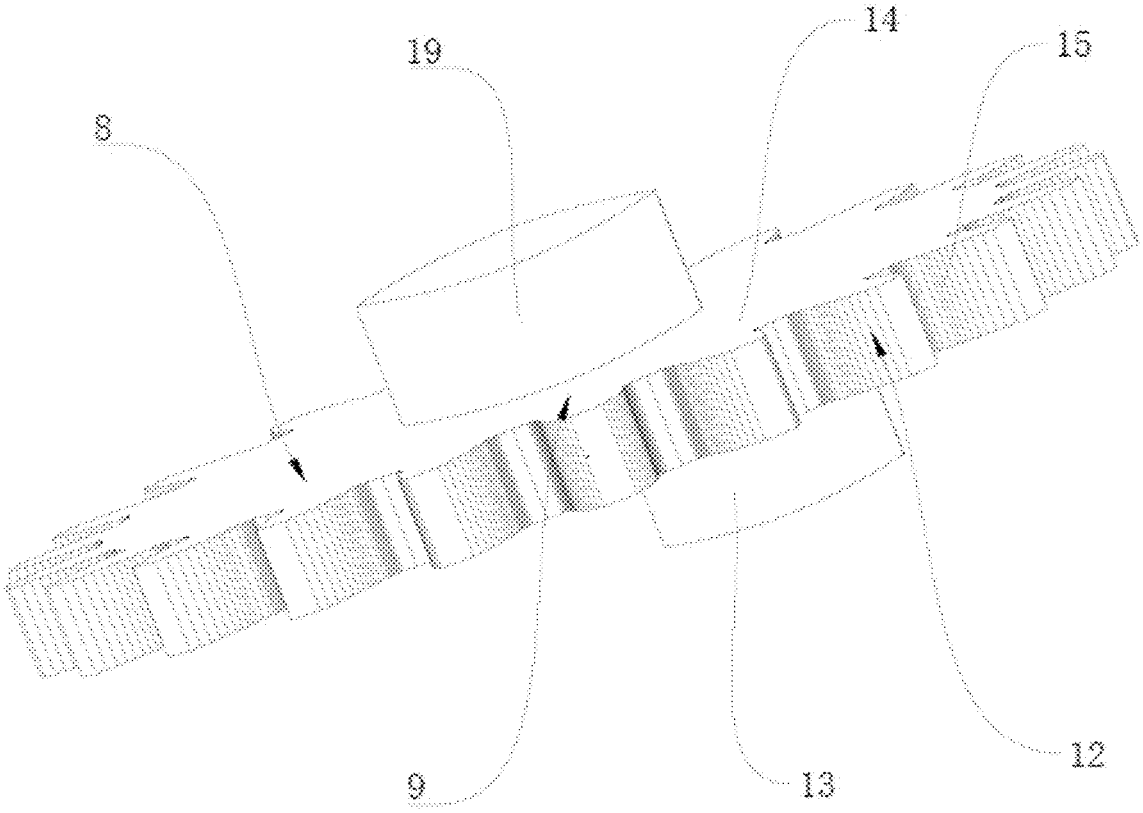
FIG. 6 is a structural schematic diagram of an eccentric wheel.

Specifically, referring to FIG. 2, FIG. 3 and FIG. 5, the radial movement guide assembly 10 includes a radial strip-shaped groove 22 formed in each of the radial push plates 7, and a positioning pin 23 fixed on the transfer disk 1 penetrates into the radial strip-shaped groove 22.

The positioning pin 23 on the transfer disk 1 penetrates through the radial strip-shaped groove 22. The positioning pin 23 cooperates with the radial strip-shaped groove 22 to play a radial movement guidance role for the radial push plates 7 in the movement process of the radial push plates 7 in the radial direction of the transfer disk 1, thereby ensuring no deviation of the movement positions of the radial push plates 7 to ensure the movement accuracy of the radial push plates 7.

Specifically, referring to FIG. 2, FIG. 3 and FIG. 5, an arc-shaped inclined plate 24 inclining outward gradually from top to bottom is arranged outside each of the radial push plates 7, an annular groove 25 is formed between a plurality of force-receiving portion moving grooves 6 and the top of the transfer disk 1, an upper end of the force-receiving portion 5 and the arc-shaped inclined plate 24 are arranged in the annular groove 25, and an outer end of the arc-shaped inclined plate 24 abuts against an inner side of the force-receiving portion 5.

When the radial push plates 7 move outward in the radial direction of the transfer disk 1, the arc-shaped inclined plate 24 outside each of the radial push plates 7 acts on the force-receiving portion 5 of each of the transfer needles 2 to push the transfer needles 2 to move outward in the radial direction of the transfer disk 1.

Specifically, referring to FIG. 1 to FIG. 4, the sliding block and sliding rail structure 4 includes a sliding groove 27 formed at the bottom of the transfer disk 1 and extending in a radial direction thereof, a sliding block 28 is arranged in the sliding groove 27, the bottom of the sliding block 28 is fixed to the top of each of the transfer needles 2, a transfer needle anti-shaking groove 29 enabling the transfer needles 2 to move in the radial direction of the transfer disk 1 is formed between the sliding groove 27 and the bottom of the transfer disk 1, the force-receiving portion 5 is arranged on a rear end of each of the transfer needles 2, and a front end of each of the transfer needles 2 is a hooked tip 30.

The sliding block 28 at the top of each of the transfer needles 2 is arranged in the sliding groove 27 of the transfer disk 1; each of the transfer needles 2 is arranged in the transfer needle anti-shaking groove 29 of the transfer disk 1; when synchronously moving outward, the radial push plates 7 can act on the force-receiving portion 5 of each of the transfer needles 2 to drive each of the transfer needles 2 in the transfer needle anti-shaking groove 29 to move outward in the radial direction of the transfer disk 1; the return force-applying portion 3 on each of the transfer needles 2 can reset each of the transfer needles 2; and in the movement process of the transfer needles 2 in the radial direction of the transfer disk 1, the hooked tip 30 at the front end cooperates with a vertical knitting needle of a hosiery machine to perform a hosiery thread transfer operation.

In the movement process of the transfer needles 2 in the radial direction of the transfer disk 1, the sliding groove 27 at the bottom of the transfer disk 1 cooperates with the sliding block 28 at the top of each of the transfer needles 2 to limit the transfer needles 2 to only moving horizontally in the radial direction of the transfer disk 1, thereby ensuring that the transfer needles 2 have no deviation on other positions during the radial movement, achieving accuracy control, and facilitating the accurate control of the positions of the transfer needles 2. The transfer needle anti-shaking groove 29 is used to accommodate the transfer needles 2 and allow the transfer needles to move in the radial direction of the transfer disk 1, so that shaking of the transfer needles 2 can be effectively avoided in the movement process, thereby achieving accuracy control and ensuring no deviation of the positions of the transfer needles 2.

Figure 7:
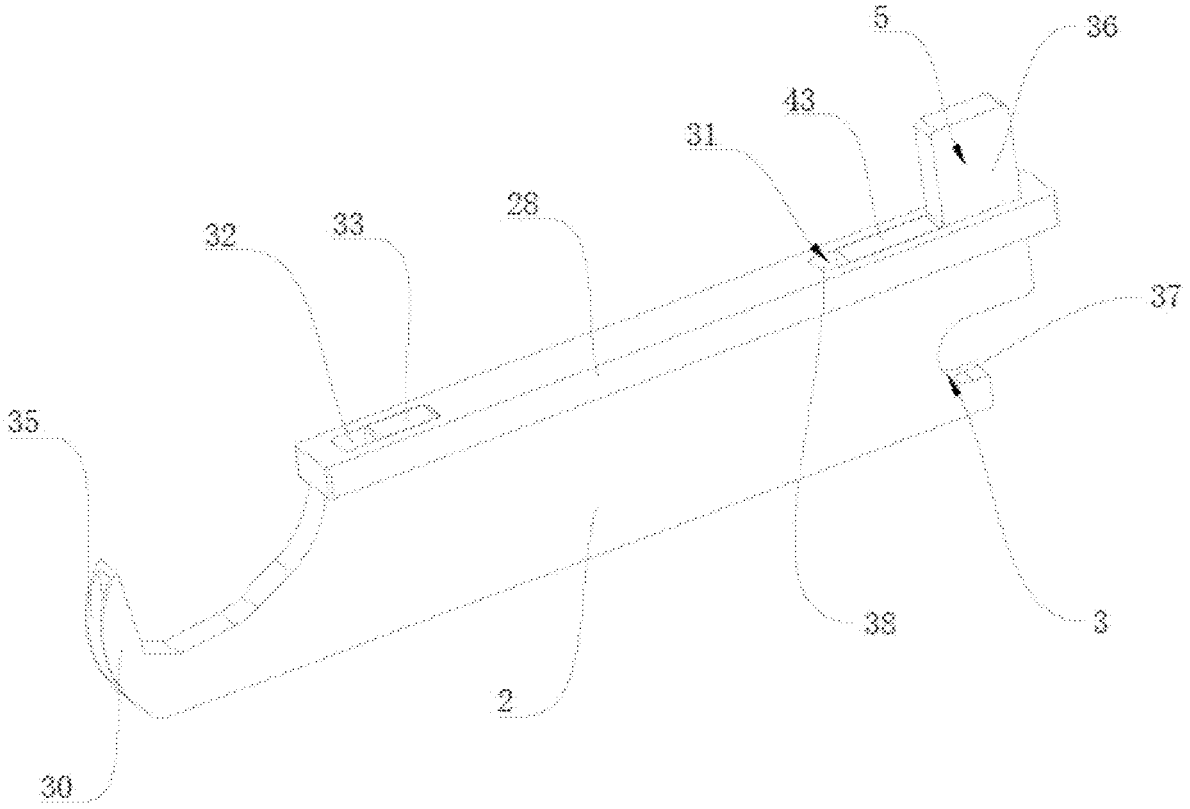
FIG. 7 is a structural schematic diagram of a transfer needle.
Figure 8:
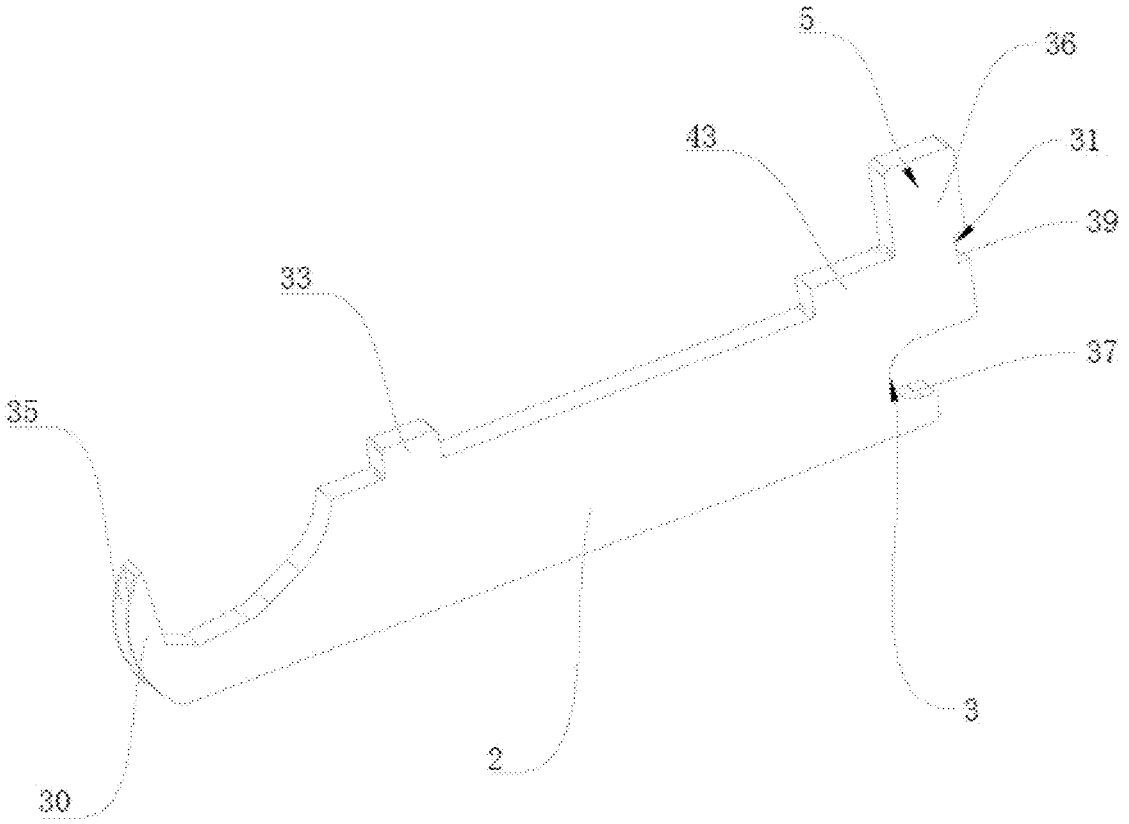
FIG. 8 is a structural schematic diagram of a mortise-and-tenon structure.
Figure 9:
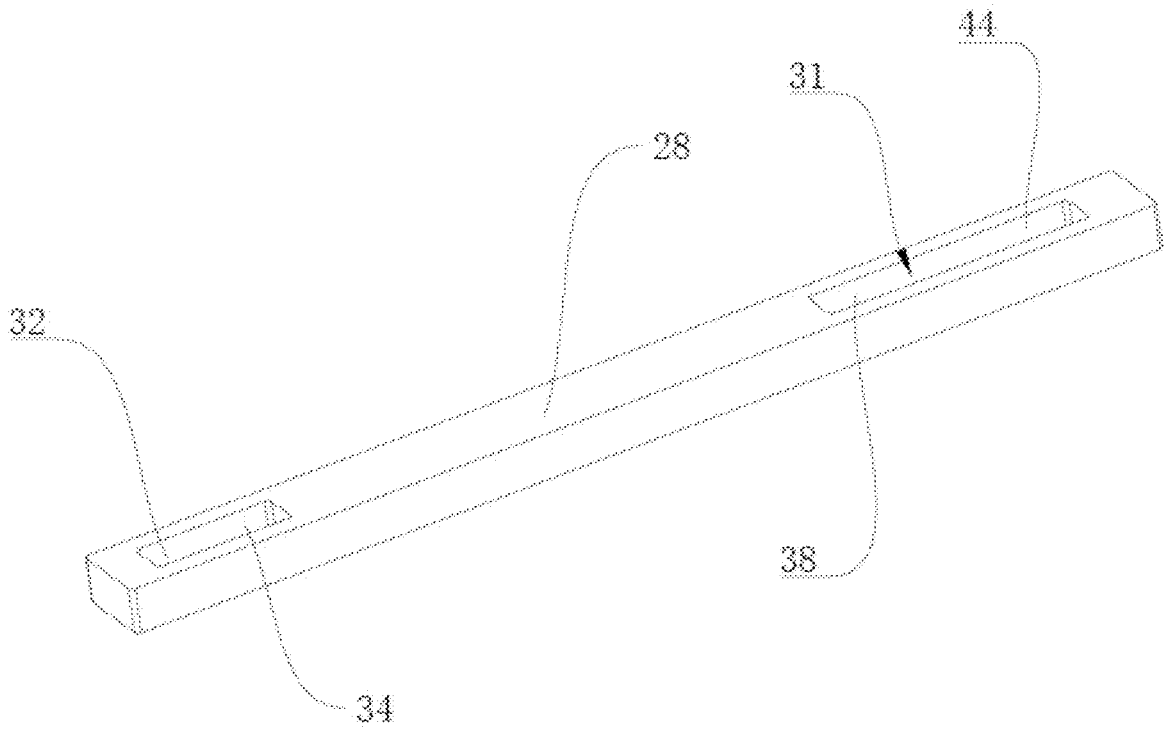
FIG. 9 is a structural schematic diagram of a sliding block.

Specifically, referring to FIG. 7 to FIG. 9, an outer end of the sliding block 28 is sleeved on the force-receiving portion 5 and is connected to each of the transfer needles 2 through a mortise-and-tenon structure 31, an inner end of the sliding block 28 is provided with a hole groove 32, a positioning column 33 at the top of each of the transfer needles 2 penetrates into the hole groove 32, a gap 34 is reserved between the hole groove 32 and the positioning column 33, so that the sliding block 28 can move axially after the hole groove 32 is sleeved into the positioning column 33 to lock the mortise-and-tenon structure 31, and the sliding block 28, the positioning column 33 and the transfer needles 2 are fixed in the gap 34 through welding, bonding or snap-fitting.

The sliding block 28 is fixedly connected to each of the transfer needles 2 through the mortise-and-tenon structure 31, and the fixation is stable.

The positioning column 33 at the top of each of the transfer needles 2 penetrates into the hole groove 32 at the front end of the sliding block 28 and cooperates with the hole groove 32 to play a positioning role, the gap 34 reserved between the hole groove 32 and the positioning column 33 facilitates the locking of the mortise-and-tenon structure 31, and the sliding block 28, the positioning column 33 and each of the transfer needles 2 are fixed in the gap 34 through welding, bonding or snap-fitting to ensure stable connection.

Specifically, referring to FIG. 7 to FIG. 9, the mortise-and-tenon structure 31 includes a mortise 38 arranged at one end of the sliding block 28, the force-receiving portion 5 is located on a rear end part of each of the transfer needles 2, the mortise 38 is sleeved on the force-receiving portion 5, and after the mortise is sleeved on the force-receiving portion, the sliding block 28 is moved axially, so that one end of the sliding block is clamped in a groove 39 of the force-receiving portion 5, and the other end of the sliding block 28 is fixedly connected to each of the transfer needles 2; and a reinforcing rib 43 is arranged on one side of the force-receiving portion 5 away from the groove 39, the reinforcing rib 43, each of the transfer needles 2 and the force-receiving portion 5 are connected into a whole, a gap 44 is formed between the mortise 38 and the reinforcing rib 43, and the reinforcing rib 43, the sliding block 28 and each of the transfer needles 2 are fixed in the gap 44 through welding, bonding or snap-fitting.

The mortise 38 at one end of the sliding block 28 is sleeved on the force-receiving portion 5 of each of the transfer needles 2; after the mortise 38 is sleeved on the force-receiving portion 5, the sliding block 28 is moved axially, so that one end of the mortise 38 is clamped into the groove 39 of the force-receiving portion 5; and after the groove 39 of the force-receiving portion 5 cooperates with one end of the mortise 38, so that the stable connection between the sliding block 28 and each of the transfer needles 2 can be ensured.

The reinforcing rib 43, for example, is rectangular, triangular and diagonal brace-shaped. In this embodiment, the reinforcing rib 43 is rectangular, and the top end of the reinforcing rib 43 is flush with the top end of the sliding block 28.

The reinforcing rib 43 on the force-receiving portion 5 cooperates with the mortise 38 of the sliding block 28, so that the connection strength between the sliding block 28 and each of the transfer needles 2 can be enhanced, thereby further ensuring the stable connection between the sliding block 28 and each of the transfer needles 2.

The gap 44 between the mortise 38 and the reinforcing rib 43 enables the sliding block 28 to move axially after the mortise 38 is sleeved on the reinforcing rib 43 and the force-receiving portion 5, thereby facilitating the locking of the mortise-and-tenon structure 31. The reinforcing rib 43, the sliding block 28 and each of the transfer needles 2 are fixed in the gap 44 through welding, bonding or snap-fitting, so that the connection stability between the sliding block 28 and each of the transfer needles 2 can be ensured.

Preferably, referring to FIG. 7 to FIG. 9, the transfer needles 2 are sheet-like, a maximum width of the sliding block 28 is greater than a width of each of the transfer needles 2, and one side of the sliding block 28 is flush with a side surface of each of the transfer needles 2 and the other side of the sliding block protrudes from a side wall of each of the transfer needles 2;

or two sides of the sliding block 28 protrude from side walls of two sides of each of the transfer needles 2, respectively.

One side of the sliding block 28 is flush with the side surface of each of the transfer needles 2, and the other side of the sliding block protrudes from the side wall of each of the transfer needles 2; and the sections of the sliding block 28 and each of the transfer needles 2 are of an inverted L shape, and the sections of the sliding groove 27 in the transfer disk 1 and the transfer needle anti-shaking groove 29 are of an inverted L shape adapted to the previous inverted L shape.

Or two sides of the sliding block 28 respectively protrude from the side walls of the two sides of each of the transfer needles 2, the sections of the sliding block 28 and each of the transfer needles 2 are of a T shape, and the sections of the sliding groove 27 in the transfer disk 1 and the transfer needle anti-shaking groove 29 are of a T shape adapted to the previous T shape.

In this embodiment, the sections of the sliding block 28 and each of the transfer needles 2 are of a T shape, and the sections of the sliding groove 27 in the transfer disk 1 and the transfer needle anti-shaking groove 29 are of a T shape adapted to the previous T shape.

Preferably, referring to FIG. 7 to FIG. 9, the return force-applying portion 3 is arranged at a rear end of each of the transfer needles 2; and an opening of the hooked tip 30 and the force-receiving portion 5 are located at the top of each of the transfer needles 2, and a clearance groove 35 is formed at an outer end of the hooked tip 30.

The clearance groove 35 at the outer end of the hooked tip 30 enables a loop on a sock knitting needle to enter a traction surface of the hooked tip 30 easily when the hooked tip 30 is close to the sock knitting needle.

Specifically, referring to FIG. 7 to FIG. 9, the return force-applying portion 3 includes a return force-applying half-hole 37 formed at the rear end of each of the transfer needles 2; a tension-compression spring is arranged in the return force-applying half-hole 37; and when the transfer needles 2 move outward in the radial direction of the transfer disk 1, the tension-compression spring is stretched to generate deformation, so that an inward force in the radial direction of the transfer disk 1 can be applied to each of the transfer needles 2, thereby resetting the transfer needles 2.

Specifically, referring to FIG. 7 to FIG. 9, the force-receiving portion 5 includes a convex block 36 arranged on a rear end part of each of the transfer needles 2.

After being stressed, the convex block 36 arranged on the rear end part of each of the transfer needles 2 can drive the transfer needles 2 to move outward in the radial direction of the transfer disk 1.

Specifically, referring to FIG. 1 to FIG. 3, a plurality of rotation limiting grooves 40 distributed in a circumferential direction of the driving tooth ring are formed at the periphery of the driving tooth ring 16, a limiting column 41 cooperating with the rotation limiting groove 40 to play a rotation limiting role for the driving tooth ring 16 is arranged at the inner step 21 on the positioning disk 20, and the bottom of the annular cover plate 18 is in cooperative connection with the limiting column 41.

Specifically, referring to FIG. 1 to FIG. 3, a rotation clearance portion 42 matched with the driving connection lug 26 is arranged on the inner step 21 and located at the driving connection lug 26 of the driving tooth ring 16; and in the rotating process of the driving tooth ring 16, the rotation clearance portion 42 plays a rotation clearance role for the driving connection lug 26.

Preferably, referring to FIG. 1 to FIG. 4, a spare sliding block groove 45 is formed between any two adjacent sliding grooves 27, and the spare sliding block groove 45 and the sliding grooves 27 are distributed in a vertically staggered manner. The spare sliding block groove 45 is used for the spare placement of the transfer needles 2.

The working principle of the present disclosure is: the tooth ring rotating driver operates to drive the driving tooth ring 16 by the driving connection lug 26 to rotate, the driving tooth ring 16 is engaged with the outer tooth bodies 15 for transmission to drive the main wheel 14 of the eccentric wheel 9 to rotate, and when the main wheel 14 rotates, the eccentric body 13 of the eccentric wheel 9 acts on the strip-shaped hole 11 of each of the radial push plates 7 to drive the radial push plates 7 to move in the radial direction of the transfer disk 1;

When the radial push plates 7 move outward in the radial direction of the transfer disk 1, the arc-shaped inclined plate 24 outside each of the radial push plates 7 acts on the force-receiving portion 5 of each of the transfer needles 2 to push the transfer needles 2 to move outward in the radial direction of the transfer disk 1; and the sliding block 28 at the top of each of the transfer needles 2 moves outward in the sliding groove 27 in the radial direction of the transfer disk 1, each of the transfer needles 2 moves outward in the transfer needle anti-shaking groove 29 in the radial direction of the transfer disk 1, the return force-applying portion 3 on each of the transfer needles 2 can reset each of the transfer needles 2, and in the movement process of each of the transfer needles 2 in the radial direction of the transfer disk 1, the hooked tip 30 at the front end cooperates with the vertical knitting needle of the hosiery machine to perform the hosiery thread transfer operation.

Embodiment 2

Figure 10:
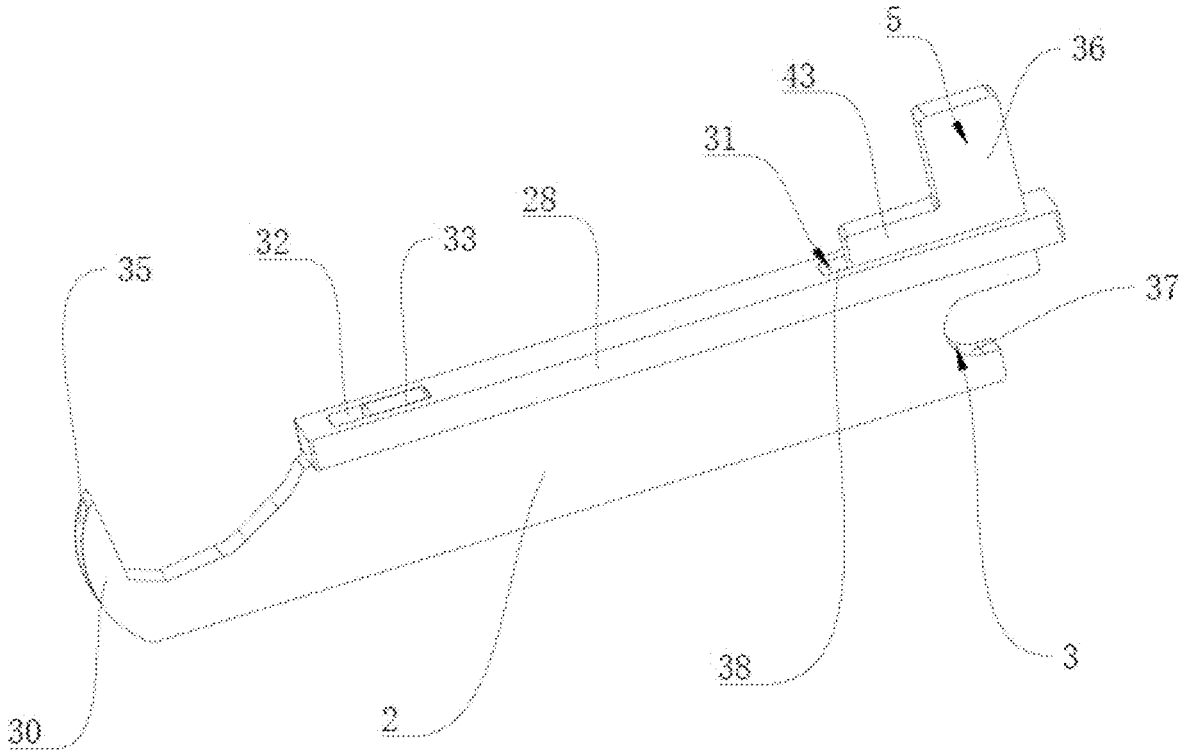
FIG. 10 is a structural schematic diagram of a transfer needle in Embodiment 2.
Figure 11:
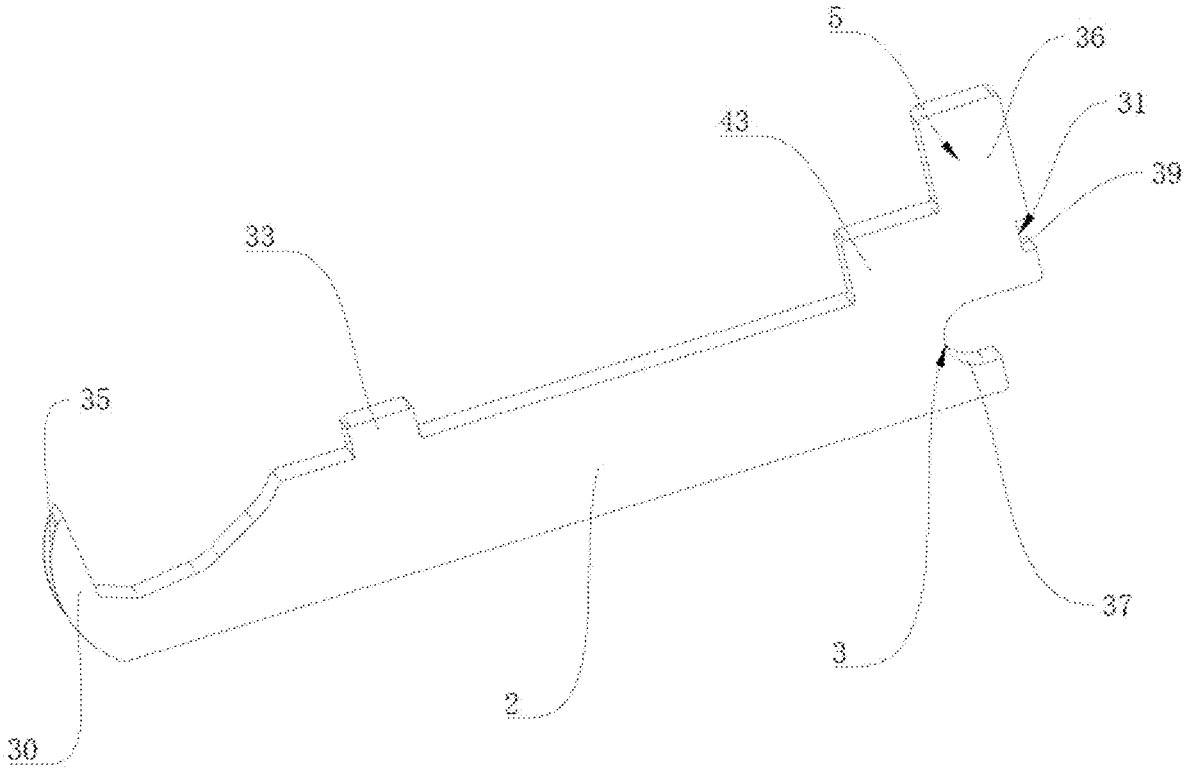
FIG. 11 is a structural schematic diagram of a mortise-and-tenon structure in Embodiment 2.

As shown in FIG. 10 and FIG. 11, the structure and working principle of this embodiment are basically the same as those of Embodiment 1, except that the reinforcing rib 43 penetrates through the mortise 38 and extends to an upper part.

The specific embodiments described herein are merely intended to illustrate the spirit of the present disclosure. A person skilled in the art can make various modifications or supplements to the specific embodiments described or replace them in a similar manner, but it may not depart from the spirit of the present disclosure or the scope defined by the appended claims.

Although more terms are used herein, these terms are used merely to more conveniently describe and explain the essence of the present disclosure, and it is contrary to the spirit of the present disclosure to construe them as any additional limitations.

The invention claimed is:

1. A transfer apparatus, comprising a transfer disk, wherein the transfer disk is provided with a plurality of transfer needles distributed in a circumferential direction thereof and capable of moving horizontally in a radial direction thereof, a return force-applying portion is arranged on each of the transfer needles, each of the transfer needles is suspended at the bottom of the transfer disk through a sliding block and sliding rail structure, each of the transfer needles is provided with a force-receiving portion, the force-receiving portion penetrates through a force-receiving portion moving groove of the transfer disk to be exposed out of the top of the transfer disk, at least three radial push plates distributed in the circumferential direction are arranged at the top of the transfer disk, when moving outward, each of the radial push plates is capable of acting on the force-receiving portion to push each of the transfer needles to move outward radially, and each of the radial push plates is connected to a radial driving mechanism; the radial driving mechanism comprises an eccentric wheel, a radial movement guide assembly is arranged between each of the radial push plates and the transfer disk, end parts of two adjacent radial push plates overlap each other, the end parts of the radial push plates are provided with strip-shaped holes at the overlapped positions, an eccentric body of the eccentric wheel is arranged in the strip-shaped holes, during rotation, the eccentric wheel is capable of driving the radial push plates to move radially, and the eccentric wheel is connected to an eccentric wheel driving assembly; the eccentric wheel driving assembly comprises outer tooth bodies arranged on a main wheel of the eccentric wheel, a plurality of outer tooth bodies are connected to a driving tooth ring, and the driving tooth ring is connected to a tooth ring driving unit; the bottom and the top of the main wheel are in contact connection with the radial push plates and an annular cover plate, respectively, and a central shaft of the main wheel penetrates through the annular cover plate and is capable of rotating between the radial push plates and the annular cover plate;

the bottom of the driving tooth ring is in contact connection with an upper surface of each of the radial push plates and an inner step on an inner side of a positioning disk of the transfer disk, and an upper surface of the driving tooth ring is in contact connection with the annular cover plate;

the annular cover plate is fixed on the transfer disk; and an arc-shaped inclined plate inclining outward gradually from top to bottom is arranged outside each of the radial push plates, an annular groove is formed between a plurality of force-receiving portion moving grooves and the top of the transfer disk, an upper end of the force-receiving portion and the arc-shaped inclined plate are arranged in the annular groove, and an outer end of the arc-shaped inclined plate abuts against an inner side of the force-receiving portion.

2. The transfer apparatus according to claim 1, wherein the radial movement guide assembly comprises a radial strip-shaped groove formed in each of the radial push plates, and a positioning pin fixed on the transfer disk penetrates into the radial strip-shaped groove.

3. The transfer apparatus according to claim 1, wherein the tooth ring driving unit comprises a driving connection lug arranged on an outer wall of the driving tooth ring, and the driving connection lug is capable of being connected to a tooth ring rotating driver.

4. The transfer apparatus according to claim 1, wherein the sliding block and sliding rail structure comprises a sliding groove formed at the bottom of the transfer disk and extending in a radial direction thereof, a sliding block is arranged in the sliding groove, the bottom of the sliding block is fixed to the top of each of the transfer needles, a transfer needle anti-shaking groove enabling the transfer needles to move in the radial direction of the transfer disk is formed between the sliding groove and the bottom of the transfer disk, the force-receiving portion is arranged on a rear end of each of the transfer needles, and a front end of each of the transfer needles is a hooked tip.

5. The transfer apparatus according to claim 4, wherein an outer end of the sliding block is sleeved on the force-receiving portion and is connected to each of the transfer needles through a mortise-and-tenon structure, an inner end of the sliding block is provided with a hole groove, a positioning column at the top of each of the transfer needles penetrates into the hole groove, a gap is reserved between the hole groove and the positioning column, so that the sliding block is capable of moving axially after the hole groove is sleeved into the positioning column to lock the mortise-and-tenon structure, and the sliding block, the positioning column and the transfer needles are fixed in the gap through welding, bonding or snap-fitting.

6. The transfer apparatus according to claim 5, wherein the mortise-and-tenon structure comprises a mortise arranged at one end of the sliding block, the force-receiving portion is located on a rear end part of each of the transfer needles, the mortise is sleeved on the force-receiving portion, and after the mortise is sleeved on the force-receiving portion, the sliding block is moved axially, so that one end of the sliding block is clamped in a groove of the force-receiving portion, and the other end of the sliding block is fixedly connected to each of the transfer needles; and a reinforcing rib is arranged on one side of the force-receiving portion away from the groove, the reinforcing rib, each of the transfer needles and the force-receiving portion are connected into a whole, a gap is formed between the mortise and the reinforcing rib, and the reinforcing rib, the sliding block and each of the transfer needles are fixed in the gap through welding, bonding or snap-fitting.

7. The transfer apparatus according to claim 4, wherein each of the transfer needles is sheet-like, a maximum width of the sliding block is greater than a width of each of the transfer needles, and one side of the sliding block is flush with a side surface of each of the transfer needles and the other side of the sliding block protrudes from a side wall of each of the transfer needles;

or two sides of the sliding block protrude from side walls of two sides of each of the transfer needles, respectively.

8. The transfer apparatus according to claim 4, wherein the return force-applying portion is arranged at a rear end of each of the transfer needles; and an opening of the hooked tip and the force-receiving portion are located at the top of each of the transfer needles, and a clearance groove is formed at an outer end of the hooked tip.

* * * * *